US006362712B1

(12) United States Patent
Kiyoshi et al.

(10) Patent No.: US 6,362,712 B1
(45) Date of Patent: Mar. 26, 2002

(54) UNIFORM MAGNETIC FORCE GENERATING MAGNET

(75) Inventors: Tsukasa Kiyoshi; Hitoshi Wada; Nobuko Wakayama, all of Ibaraki (JP)

(73) Assignees: Japan Science and Technology Corporation, Saitama; Japan as represented by Director General of National Reseacrh Institute for Metals, Ibaraki; Japan as represented by Director General of Agency of Industrial Science and Technology, Tokyo, all of (JP)

( * ) Notice: Subject to any disclaimer, the term of this patent is extended or adjusted under 35 U.S.C. 154(b) by 0 days.

(21) Appl. No.: 09/700,488

(22) PCT Filed: May 19, 1999

(86) PCT No.: PCT/JP99/02607

§ 371 Date: Feb. 13, 2001

§ 102(e) Date: Feb. 13, 2001

(87) PCT Pub. No.: WO99/60584

PCT Pub. Date: Nov. 25, 1999

(30) Foreign Application Priority Data

May 19, 1998 (JP) ..... 10/137220

(51) Int. Cl.[7] ..... H01F 5/00

(52) U.S. Cl. ..... 335/299

(58) Field of Search ..... 335/216, 296–306; 324/318–320

(56) References Cited

U.S. PATENT DOCUMENTS 5,485,088 A * 1/1996 Westphal et al. ..... 324/320
5,521,571 A * 5/1996 Laskaris et al. ..... 335/216

FOREIGN PATENT DOCUMENTS

JP 61-200452 * 9/1986
JP 8-45729 * 2/1996

* cited by examiner

*Primary Examiner*—Ramon M. Barrera
(74) *Attorney, Agent, or Firm*—Wenderoth, Lind & Ponack, L.L.P.

(57) ABSTRACT

Magnets comprising main magnets formed by arranging a single main magnet or plural main magnets, and auxiliary magnets for uniformalizing the magnetic force of the main magnets in a predetermined space. The magnets uniformalize the magnetic force in space.

11 Claims, 5 Drawing Sheets

UNIFORM MAGNETIC FORCE GENERATING MAGNET

TECHNICAL FIELD

This invention relates to magnets for generating a uniform magnetic force. More specifically, the invention relates to new magnets capable of imparting a uniform magnetic force in a predetermined space in a variety of instances such as synthesizing a substance, growing crystals, etc.

BACKGROUND ART

In a magnetic field generated by a magnet, a substance receives a magnetic force which varies in proportion to:

(Intensity of the magnetic field)×(gradient of intensity of the magnetic field:gradient of the magnetic field)

The magnetic force is utilized, for example, for separating empty cans by using magnet and in a process for magnetic separation such as removing impurities from industrial water.

The magnetic force is a physical quantity that acts not only on a ferromagnetic material such as iron but also on all substances that exhibit diamagnetism or paramagnetism. In recent years, powerful magnets have been produced by utilizing a superconductor to obtain a magnetic force which is far greater than those obtained thus far, and have been utilized as a variety of reaction control factors.

In practice, however, magnetic force that spontaneously exists around a magnet varies in space, and cannot be utilized for physical and engineering purposes. In order to utilize the magnetic force for the reaction processes, therefore, it becomes necessary to design the intensity and shape of a magnetic field by combining magnets to control the magnitude and distribution of the magnetic force in a sufficiently wide space.

A magnetic force that is symmetrical relative to an axis can be expressed, for example, by the following formula, $$Fz = x\left(Hr\frac{\partial Hr}{\partial z} + \mathrm{Hz}\frac{\partial \mathrm{Hz}}{\partial z}\right)$$

$$Fr = x\left(Hr\frac{\partial Hr}{\partial r} + \mathrm{Hz}\frac{\partial \mathrm{Hz}}{\partial r}\right)$$

where $\chi$ is a volume susceptibility, and H is an intensity of the magnetic field.

The term uniform magnetic force means a magnetic force Fz that is constant in the axial direction in a given space, and a magnetic force Fr, which is an error component in the radial direction, is as small as possible. In an isotropic substance, a magnetic flux density B varies in proportion to the intensity of the magnetic field. To generate a magnetic force that is spatially uniform, therefore, the magnet must satisfy the following formulas, $$Fz' = Br\frac{\partial Br}{\partial z} + Bz\frac{\partial Bz}{\partial z} = \text{constant}$$

$$Fr' = Br\frac{\partial Br}{\partial r} + Bz\frac{\partial Bz}{\partial r} \rightarrow O$$

There have heretofore been proposed and practically used a magnet that generates a uniform magnetic field like an NMR magnet and a magnet that generates a uniform magnetic field gradient like quadrupole magnets in an accelerator. However, no magnet has ever existed for controlling the (magnetic field)×(gradient of the magnetic field) as represented by the above formula for obtaining a field of uniform magnetic force. With the existing technology, therefore, the distribution of the magnetic force is not spatially uniform, and the magnetic force varies greatly depending upon the positions even in a working space for synthesizing a substance or for growing crystals. In a strict sense, the substance could not be synthesized or the crystals could not be grown while controlling the magnetic force.

It is therefore an assignment of this invention to provide novel magnets for generating a uniform magnetic force that make it possible to spatially uniformalize the magnetic force as the (magnetic field)×(gradient of the magnetic field) depending upon a change in the magnetic field by eliminating the above problems inherent in the prior art.

SUMMARY OF THE INVENTION

In order to solve the above assignment, the invention of this application provides magnets for generating a uniform magnetic force, comprising one or more main magnets formed by arranging a single magnet or plural magnets, and auxiliary magnets for uniformalizing the magnetic force of the main magnets in a predetermined space.

The invention of this application further provides the magnets for generating a uniform magnetic force, wherein the main magnets are air-core magnets, and the air core serves as the predetermined space, provides the magnets for generating a uniform magnetic force, wherein the auxiliary magnets are air-core magnets, provides the magnets for generating a uniform magnetic force, wherein the main magnets and the auxiliary magnets are electromagnets, and provides the magnets for generating a uniform magnetic force, wherein the positions of the auxiliary magnets can be varied relative to the main magnets.

DETAILED DESCRIPTION OF PREFERRED EMBODIMENTS OF THE INVENTION

The invention of this application has features as described above. This invention was completed based on a discovery that in order to uniformalize the (intensity of the magnetic field)×(gradient of the magnetic field) in space not at one point only but maintaining a three-dimensional expansion, a single magnet only is not sufficient, but auxiliary magnets are indispensable for correcting the magnetic force.

A more detailed embodiment will now be described. The magnet for generating a uniform magnetic force of this invention comprises a single main magnet or plural main magnets, and a single auxiliary magnet or plural auxiliary magnets. Here, the main magnets and the auxiliary magnets may be either permanent magnets or electromagnets. It is desired to use the electromagnets for controlling the intensity of the magnetic field, for controlling the gradient of the magnetic field and for controlling the magnetic force as the (intensity of the magnetic field)×(gradient of the magnetic field). It is further desired that the positions of the auxiliary magnets are variable relative to the main magnets.

It is desired that the main magnets are air-core magnets from the standpoint of relatively easily forming predetermined space of a uniform magnetic force. If the magnetic force produced by the main magnets could be uniformalized in the predetermined space, any shape and any arrangement may be employed as matters of design. It can be contrived to employ those of the air-core type or the divided air-core type.

Figure 1:
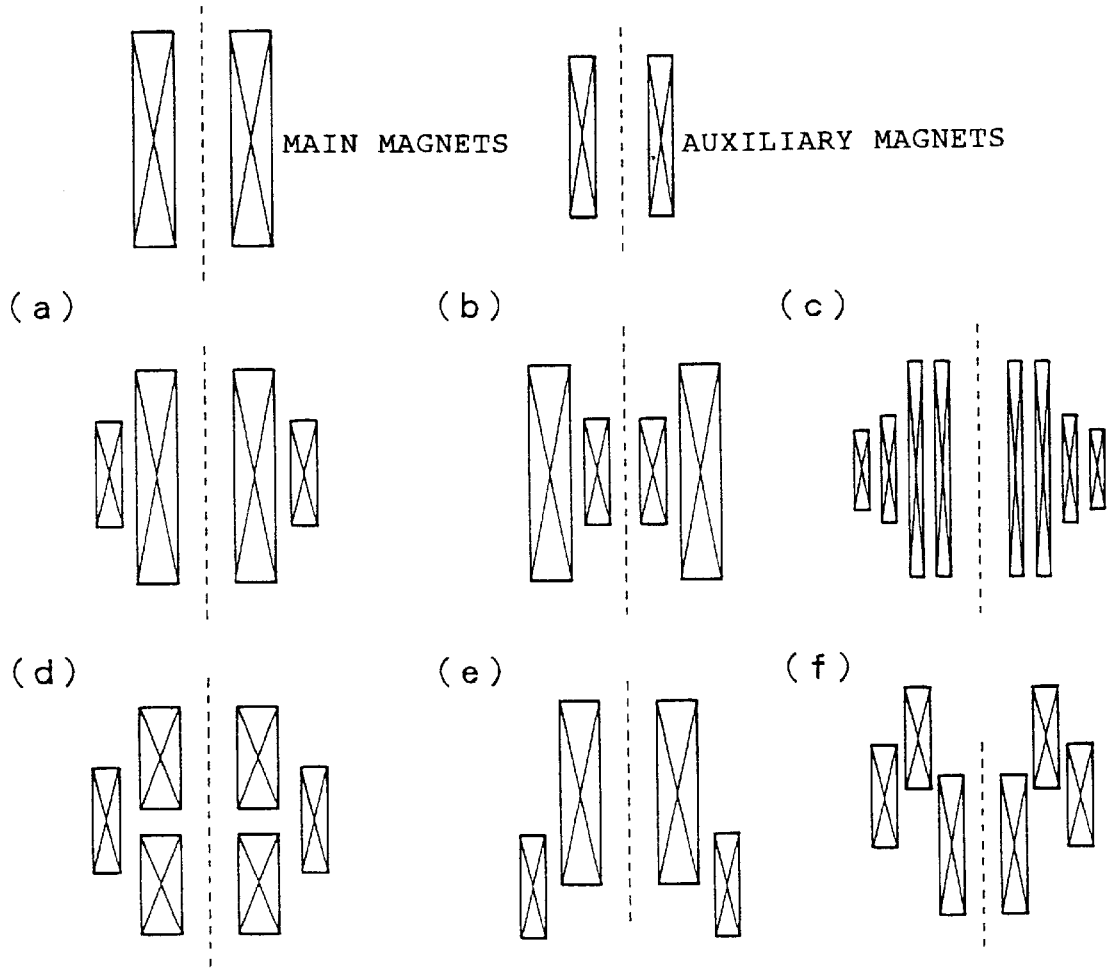
FIGS. 1(*a*) to 1(*f*) are sectional views illustrating the constitution of exemplary embodiments of magnets of this invention.

FIG. 1 illustrates examples of arrangement of the air-core main magnets and of the auxiliary magnets. The magnets can be arranged as shown in FIGS. 1(*a*) to 1(*f*). The auxiliary magnets are varied in the Z-axis direction and in the radial direction to control the spatial position where the uniform magnetic force is generated.

The arrangement of the main magnets and the auxiliary magnets is generally so designed that the distribution of the magnetic field (of all magnets) in space of a desired uniform magnetic force on the Z-axis is approximated by the following formula, $$B_z = \pm\sqrt{c_1 \cdot z + c_2}$$

where $c_1$ and $c_2$ are constants.

It needs not be pointed out further that the arrangement may be roughly determined through experiment as an indication of design.

Working examples will now be described to illustrate the magnets of this invention in further detail.

EXAMPLE

Example 1

Figure 2:
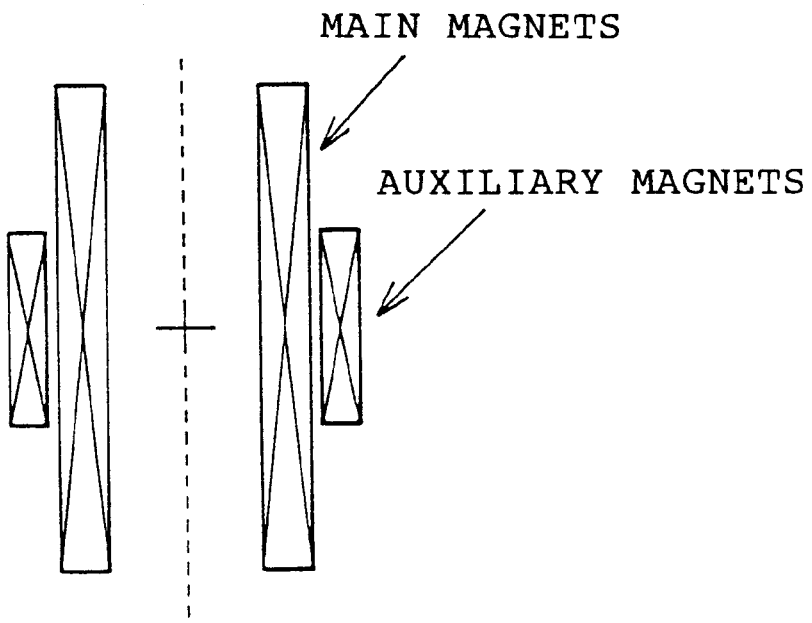
FIG. 2 is a sectional view illustrating the constitution of the magnets used in an embodiment 1.

FIG. 2 illustrates an arrangement of the air-core main magnets and the auxiliary magnets. NbTi wires are used for these magnets. Table 1 shows their specifications.

TABLE 1

| | Main magnet | Aux. magnet |
|---|---|---|
| Inner diameter (mm) | 106 | 187.87 |
| Outer diameter (mm) | 167.87 | 255.36 |
| Length (mm) | 355.2 | 156.07 |
| Current density (A/mm$^2$) | 148.2 | 148.2 |

Figure 3:
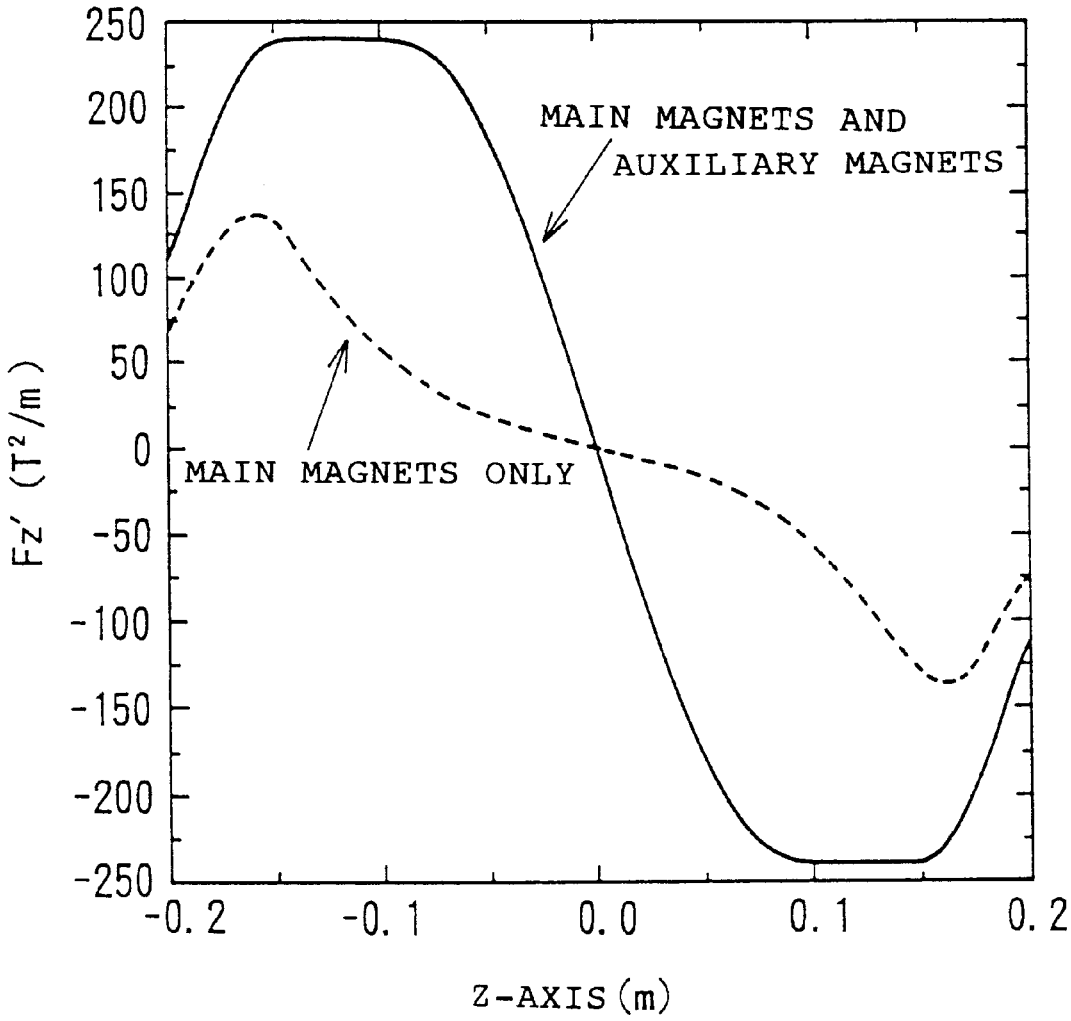
FIG. 3 is a diagram illustrating the distribution of the magnetic force on the Z-axis according to the embodiment 1.

FIG. 3 illustrates the distribution (with the equator plane of the magnet as an origin) on the Z-axis of the magnetic force (Fz) obtained by the thus constituted magnets. For comparison, FIG. 3 also shows the distribution of the magnetic force of the main magnets only.

As will be obvious from FIG. 3, the magnets of the invention having auxiliary magnets make it possible to greatly improve the maximum magnetic force and the uniformity of the magnetic force on the region along the Z-axis.

Example 2

Figure 4:
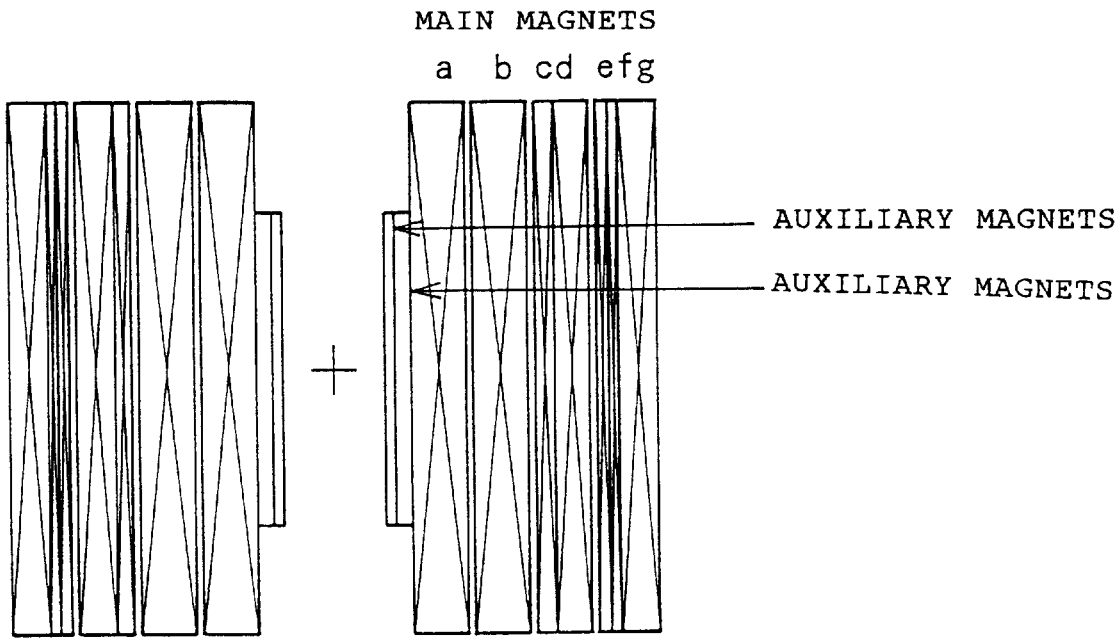
FIG. 4 is a sectional view illustrating the constitution of the magnets used in an embodiment 2.
Figure 5:
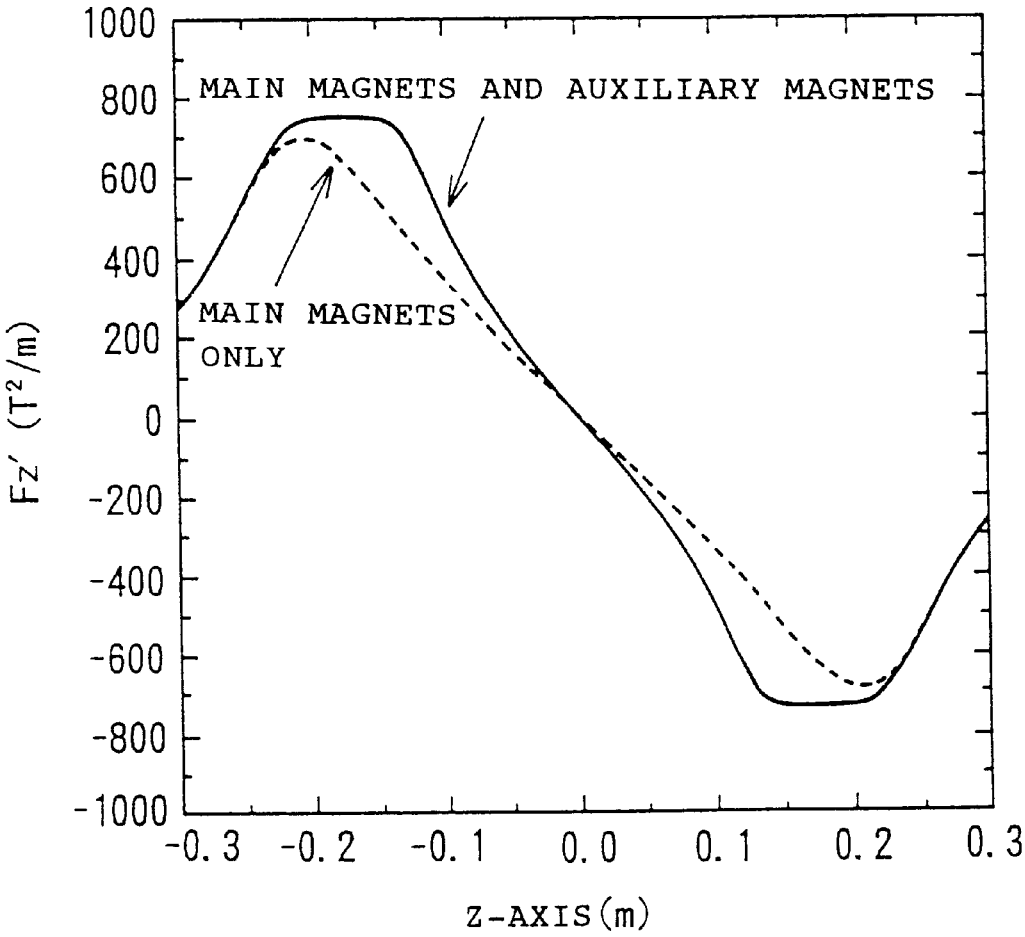
FIG. 5 is a diagram illustrating the distribution of the magnetic force on the Z-axis according to the embodiment 2.

FIG. 4 and Table 2 show an example of the magnets for generating a uniform magnetic force by using $Nb_3Sn$ superconducting wires and NbTi superconducting wires. FIG. 5 illustrates the distribution (with the equator plane of the magnet as an origin) on the Z-axis of the magnetic force (Fz) obtained by the thus constituted magnets. It was confirmed that the uniformity was greatly improved in the Z-axis direction upon combining the auxiliary magnets.

TABLE 2

| | Main magnet | | | | | | | Aux. magnet | |
|---|---|---|---|---|---|---|---|---|---|
| | a | b | c | d | e | f | g | A | B |
| Inner diameter (mm) | 130.295 | 234.292 | 335.925 | 367.797 | 438.424 | 458.65 | 473.481 | 86 | 100.498 |
| Outer diameter (mm) | 222.292 | 321.925 | 367.797 | 424.424 | 458.65 | 473.481 | 536.262 | 100.498 | 118.295 |
| Length (mm) | 460 | 460 | 460 | 463 | 460 | 460 | 460 | 271 | 271 |
| Current density (A/mm$^2$) | 75.7 | 75.7 | 75.8 | 82.8 | 97.8 | 118 | 148 | 63.5 | 74.6 |

INDUSTRIAL APPLICABILITY

Space of a uniform magnetic force was not so far realized, but the magnets of the invention generate the uniform magnetic force for the first time. This makes it possible to quantitatively measure the effect of the magnetic force that could not be accomplished so far. Further, by superposing the gravity and a field of variable magnetic force upon a substance, it is allowed to generate virtual field of variable gravity making it possible to easily carry out, on the ground, experiment while varying the apparent gravity that could so far be accomplished only in a space shuttle or by conducting a special falling testing.

It has been reported that crystals of proteins of good quality are obtained when the gravity is very small, and it is expected that the magnetic force greatly affects the synthesis of proteins and substances. It is therefore expected that the magnets will find a widespread use in the industries of materials inclusive of semiconductors and in the field of living bodies and medicine.

What is claimed is:

1. A magnet arrangement for generating a uniform magnetic force, said magnet arrangement comprising:

one or more main magnets, each main magnet comprising one or more magnets, said main magnets exhibiting a magnetic force; and one or more auxiliary magnets positioned relative to said main magnets so as to uniformalize the magnetic force of said main magnets in a predetermined space.

2. A magnet arrangement according to claim 1, wherein said main magnets are air-core magnets having an air core, and said air core of said main magnets define said predetermined space.

3. A magnet arrangement according to claim 2, wherein said auxiliary magnets are air-core magnets.

4. A magnet arrangement according to claim 2, wherein said main magnets and said auxiliary magnets are electromagnets.

5. A magnet arrangement according to claim 2, wherein said auxiliary magnets have a variable position relative to said main magnets.

6. A magnet arrangement according to claim 1, wherein said auxiliary magnets are air-core magnets.

7. A magnet arrangement according to claim 6, wherein said main magnets and said auxiliary magnets are electromagnets.

8. A magnet arrangement according to claim 6, wherein said auxiliary magnets have a variable position relative to said main magnets.

9. A magnet arrangement according to claim 1, wherein said main magnets and said auxiliary magnets are electromagnets.

10. A magnet arrangement according to claim 9, wherein said auxiliary magnets have a variable position relative to said main magnets.

11. A magnet arrangement according to claim 1, wherein said auxiliary magnets have a variable position relative to said main magnets.

* * * * *